United States Patent [19]

Kobayashi

[11] Patent Number: 4,540,975

[45] Date of Patent: Sep. 10, 1985

[54] ELECTRIC HORNS

[75] Inventor: Shigeru Kobayashi, Naganoken, Japan

[73] Assignee: Marukokeihouki Co., Ltd., Maruko, Japan

[21] Appl. No.: 366,106

[22] Filed: Apr. 6, 1982

[51] Int. Cl.[3] ..... G08B 3/00

[52] U.S. Cl. ..... 340/388; 340/384 R; 340/404; 340/391

[58] Field of Search ..... 340/388, 384 R, 404, 340/391; 116/142 R; 179/115.5 ES

[56] References Cited

U.S. PATENT DOCUMENTS 1,186,122 6/1916 Norgate ..... 340/388
2,624,226 1/1953 Hansen ..... 340/384 R

FOREIGN PATENT DOCUMENTS 2371036 7/1978 France ..... 340/391
57-72499 5/1982 Japan .

*Primary Examiner*—John W. Caldwell, Sr.
*Assistant Examiner*—Ellwood G. Harding
*Attorney, Agent, or Firm*—Jordan and Hamburg

[57] ABSTRACT

An electromagnet is formed of a combination of an iron support, an iron piece, and a solenoid, and an interrupter is provided to intermittently excite said electromagnet. A cylindrical diaphragm, equipped with an armature so disposed as to come against said iron piece, covers said iron support so that said iron piece, said solenoid, and said interrupter may be enclose therein.

4 Claims, 4 Drawing Figures

ELECTRIC HORNS

BACKGROUND OF THE INVENTION

1. Field of the Invention

The present invention is related to electric horns, in more particular to electric horns which are light in weight and excellent in sound quality and may suitably be used for cars.

2. Description of the Prior Art

FIG. 1 shows the conventional electric horn.

(1) is an iron casing consisting of the 1st and 2nd cylindrical casings (2) and (3), i.e., casing having bottoms; casing (2) has a flange section (6) around its upper edge and also has casing (3), smaller in diameter, fitted to the hole in its bottom plane.

Solenoid coil (4) is placed inside of the casing (3) and at its axial center, iron piece (5) is positioned, forming an electromagnet containing the iron casing as the external magnetic circuit.

(7) is a diaphragm covering the open section of casing (1), and (8) is an armature fixed on diaphragm (7) against iron piece (5). (9) is an interrupter for intermittent excitation of the solenoid, and (10) is a resonant plate provided against diaphragm (7).

Intermittent excitation of the solenoid will cause armature (8) to hit iron piece (5) strongly and intermittently to make sounds of high intensity with the aid of the resonance effect given by the combination of diaphragm (7) and resonant plate (10).

With the conventional horn of such a structure, it is iron casing (1) that contributes most to the weight of product among the components. Thus, reduction in thickness of the material for casing (1) is most effective for the reduction in weight of the product, but some problems relating to magnetism and mechanical strength impose a restriction on the applicability of the thickness reduction.

Reduction of the horn in outer diameter is conceivable, but some problems relating to sound quality, etc. make this idea inapplicable. It is thus an extremely difficult technological object to reduce the product in size and weight lowering the level of sound quality, etc. In addition, since the conventional structure holds the flat-plate-shaped diaphragm (7) by employing the fixing ring (10') to clamp the edge of diaphragm (7) around the flange section (6), diaphragm (7) will be distorted with unfavorable effects on the sound quality, frequency, etc.

The present invention is directed to the provision of electric horns which are free from the above-mentioned defects.

SUMMARY OF THE INVENTION

Under the above-described situation, the main object of the present invention is to provide electric horns with improved sound quality and reduced weight. The other important object of the present invention is to provide electric horns which may reduce both the number of parts and manufacturing cost by making it possible to fix the diaphragm without using any separate fixing rings.

SPECIFICATION OF THE INVENTION

Figure 1:
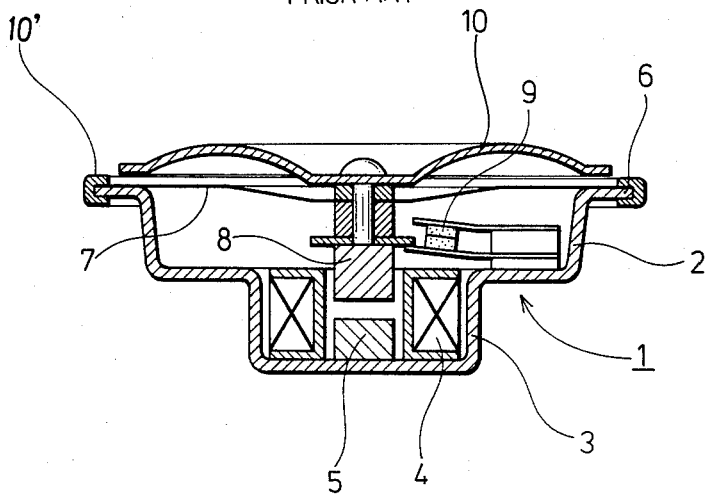
FIG.1 PRIOR ART
FIG. 1 is the sectional view of the conventional horn.
Figure 2:
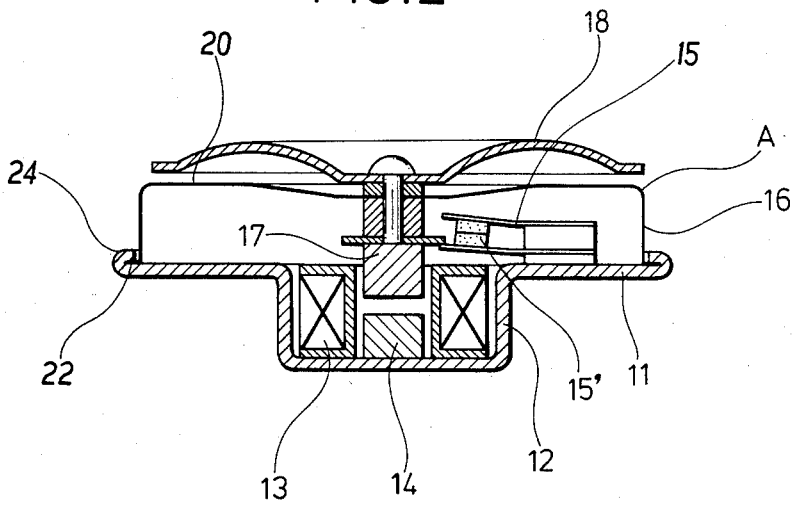
FIG. 2 is the sectional view of an example of electric horn based on the present invention.

In FIG. 2, (11) is an iron base serving as an iron support material, whose middle section is depressed to form the bottom-provided cylindrical section (12). (13) is a solenoid coil accommodated in the bottom-provided cylindrical section (12), and (14) is an iron piece fixed at the axial center of the solenoid coil (13). This combination of iron base (11), bottom-provided cylindrical section (12), solenoid coil (13), and iron piece (14) constitutes an electromagnet. (15) is an interrupter provided with contact (15'); opening and closing of this contact (15') turns on and off the passage of electric current through solenoid coil (13), with intermittent excitation of said electromagnet.

(20) is a diaphragm covering solenoid coil (13), iron piece (14), and interrupter (15); circular wall (16) is formed by bending around point A so that the excitation of said electromagnet may result in efficient operation of diaphragm. Diaphragm (20) is fixed on base (11) in such a way that its flange section (22) provided around the lower edge of its circular wall (16) is to be held between the folded section (24) around the edge of base (11).

(17) is an armature, fixed on diaphragm (20) against iron piece (14). (18) is a resonant plate, which is fixed at the middle of the upper plane of diaphragm (20) and the edge of which is at a certain interval from the upper plane of diaphragm, forming a resonant space.

Intermittent excitation of the solenoid will cause armature (17) to hit iron piece (14) strongly and intermittently to make sound of high intensity with the aid of the resonance effect given by the set of diaphragm (20) and resonant plate (18).

As described above, according to the present invention, the section corresponding to the 1st cylindrical casing (1.2 mm in thickness) in the conventional horn is replaced by circular wall (16) formed by bending diaphragm (20) (0.35 mm in thickness) This replacement has resulted in a great weight reduction, e.g., as much as 20 g with a horn 88 mm in O.D. (total horn weight 260 g).

In fixing base (11) on diaphragm (20), base (11) need not be folded around its edge as described above; instead, by employing a separate fixing ring (not shown), U-shaped in section, as in the conventional structure, the edge of base (11) and flange section (22) of diaphragm (20) may be held together.

Figure 3:
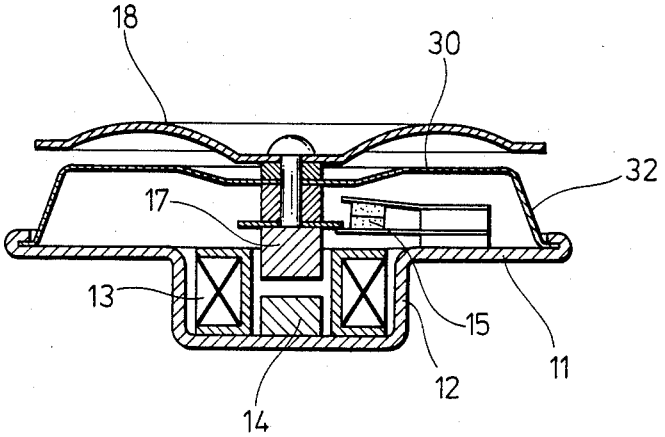
FIG. 3 is the sectional view of a diaphragm as an application example.
Figure 4:
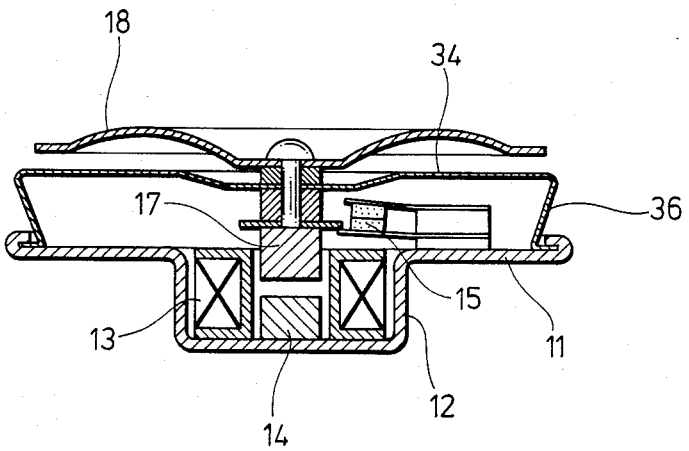
FIG. 4 is the sectional view of a diaphragm as another application example.

FIGS. 3 and 4 show diaphragms of other forms as application examples. In FIG. 3, the cross-section of the diaphragm assumes a form of a trapezoid in which circular wall (32) of diaphragm (30) increases in diameter toward its lower section; in FIG. 4, the cross-section of the diaphragm assumes the form of an inverted trapezoid in which circular wall (36) of diaphragm (34) decreases in diameter toward its lower section. Both the diaphragms may display the same functional effects with the above-described application example.

As described above, according to the present invention, the diaphragm is designed to be a cylinder provided with a bottom. With this structure, the stress distortion caused on the diaphragm in its fixing on the base may be absorbed by the circular wall and thus the vibratory section of the diaphragm may be almost free from any effects of stress distortion and sounds of excellent quality free of noises such as beats and buzzings may be obtained; in addition, the diaphragm may vibrate with high efficiency and thus stable states of sounding are obtainable over a wide voltage range.

The present invention is effective for reducing manufacturing cost, since the base is designed to be of a plate having a dent at its middle part for accommodation of the iron piece and solenoid coil and the diaphragm is designed to be a cylinder provided with a bottom, thus enabling us to reduce the weight of the entire horn with the high quality of sound maintained.

The present invention is effective also for reducing the number of the parts used and therefore for reducing the manufacturing cost through the adoption of the mechanism for attaching the diaphragm to the base in which the base is folded around its edge to catch the flange secton of diaphragm; this structure, which has hitherto been inapplicable because of too much stress distortion being caused by the fixation of the diaphragm on the base, has been made applicable by the present invention which uniquely employs the diaphragm having the circular wall effective, as described above, for absorbing the stress distortion.

What we claim is:

1. In an electric horn composed of an electromagnet formed with an iron support and the combination of an iron piece and a solenoid coil fixed on said iron support, an interrupter for intermittently exciting said electromagnet, a diaphragm fixed around said iron support material to cover said combination of said iron piece, solenoid coil, and interrupter, and an armature fixed on said diaphragm against said iron piece, the improvement wherein said diaphragm comprises a cylinder having a bottom wall and a circular wall extending from said bottom wall toward said iron support and affixed to said iron support, said iron support having a cylindrical dent in the middle section, the dent having a bottom accommodating said iron piece and solenoid coil.

2. The horn of claim 1 wherein said diaphragm has a trapezoid section.

3. The horn of claim 1 wherein said diaphragm has an inverted trapezoid section.

4. The horn of claim 1, wherein said diaphragm has, around the lower edge of its circular wall, a flange section extending outward, said iron support has, around its edge, a folded section, and said flange section is held by said folded section.

* * * * *